United States Patent [19]

Reid et al.

[11] 4,056,079

[45] Nov. 1, 1977

[54] APPARATUS AND PROCESS FOR PREHEATING MAIN BOILER SUPERHEATER HEADERS

[75] Inventors: Alan Reid, Columbia; Wendell C. Phillips, Jr., Harwood, both of Md.

[73] Assignee: The United States of America as represented by the Secretary of the Navy, Washington, D.C.

[21] Appl. No.: 701,486

[22] Filed: June 30, 1976

[51] Int. Cl.[2] ..... F22G 3/00; F22B 37/42

[52] U.S. Cl. ..... 122/476; 122/1 R; 122/504

[58] Field of Search ..... 122/1 R, 406 S, 406 ST, 122/459, 460, 476, 504; 60/646, 657

[56] References Cited

U.S. PATENT DOCUMENTS

| | | | |
|---|---|---|---|
| 3,062,553 | 11/1962 | Juzi | 60/646 |
| 3,636,929 | 1/1972 | Sanders | 122/476 |
| 3,918,411 | 11/1975 | Wolowodiuk | 122/1 |

*Primary Examiner*—Kenneth W. Sprague

*Attorney, Agent, or Firm*—R. Sciascia; R. Beers; S. Sheinbein

[57] ABSTRACT

An apparatus and process for preventing thermal shock caused by the introduction of steam into a superheater header by preheating the header with an electrical heating element located on the header before boiler light-off and the introduction of any steam. A temperature sensor located on the header controls the coupling of the heating element to its voltage source to maintain the temperature of the header within a predetermined range.

12 Claims, 2 Drawing Figures

APPARATUS AND PROCESS FOR PREHEATING MAIN BOILER SUPERHEATER HEADERS

BACKGROUND OF THE INVENTION

This invention relates generally to main boiler superheater headers, and more particularly to preventing thermal shock to such headers by the initial introduction of steam to them.

In a typical main boiler design the steam from the main boiler is passed to a superheater which raises the steam temperature. The superheater itself is generally made up of an inlet header, superheater tubes located close to the main boiler flame, and an outlet header. Steam from the boiler flows into the inlet header until it reaches a division plate which prevents its further flow through the header and forces the steam into the tubes. When the steam reaches the outlet headers, a division plate there forces it back to the inlet header via other superheater tubes. By the use of the division plates the steam can be forced to pass back and forth for several passes in the superheater tubes in which the temperature of steam in the tubes is increased or "superheated" to a specific temperature at which the steam exit the superheater at the outlet header and proceeds to whatever apparatus will use the steam to accomplish work.

In the operation of a main boiler it generally requires some time after light-off of the boiler flame before sufficient steam is generated to flow through the superheater. In the meantime, the superheater tubes, which are located quite close to the flame, are subjected to extreme temperatures. To help prevent warpage of the tubes, it has been found useful to introduce "protection steam" from an auxillary source to run through the superheater until the main boiler generates enough of its own steam to establish an adequate flow through the superheater.

A problem which has been found to exist is a high degree of superheater header cracking, particularly in 600 p.s.i. and above main boilers. This problem is not confined to the particular boiler design nor to one boiler manufacturer. Many causes have been suggested for contributing to this problem, including: thermal shock, header design, high "locked-in" stresses, improper drainage, improper expansion, and improper protection steam piping. In addition, it is generally believed that the use of protection steam while protecting the superheater tubes actually increases the tendency toward header cracking.

The reduction of thermal shock caused by the initial introduction of steam into the header is a critical factor which must be controlled to alleviate header cracking. This is particularly true in the superheater inlet header, in the first pass region, where the highest initial transients are experienced during cold-iron light-off (i.e. when the boiler and header were initially at room temperature). It has been estimated that these initial transients may be as high as 400° F within thirty seconds.

The prior art in the area of superheater control has been limited to stabilization of the temperature of the steam after its introduction into the superheater. Such temperature stability has been achieved by methods such as mixing the superheater steam with anxiliary steam, introducing temperature rasing material (e.g. magnesuim particles) into the superheater, and controlling the boiler air-fuel mixture. Although such temperature control is useful for several reasons, it fails to alleviate the thermal shock caused by the initial intorduction of steam into the superheater.

SUMMARY OF THE INVENTION

Accordingly, there is provided a method and apparatus for preheating superheater headers to a desired temperature prior to both boiler light-off and the introduction of any steam to the headers. By gradually warming up the headers, they can reach a temperature equivalent to that which would be induced in them almost immediately after boiler light-off, typically about 400° F. The headers will be gradually expanded by the preheating rather than forced into rapid expansion by a sudden temperature surge. After the desired temperature is reached, the header is maintained in a temperature around it, preferable 350° F to 450° F.

Preheating is accomplished with an electrical heating element located on the external surface of the header(s). The heating element is coupled to a voltage source via a relay. By controlling the relay to connect and disconnect the heating element from its voltage source in accordance with a header temperature sensor, the header can further be maintained within the desired temperature range.

OBJECTS OF THE INVENTION

It is therefore an object of the present invention to provide for a controlled preheating of main boiler superheater headers.

Another object of the present invention is the alleviation of superheater header cracking by reduction of thermal shock and transients of initial steam introduction.

A further object of the present invention is to increase superheater reliability by the reduction of header cracking.

Yet another object of the present invention is allowing for the use of protection steam to prevent superheater tube warpage while minimizing any tendency of the protection steam to promote header cracking.

Still another object of the present invention is to reduce the risk of casualty losses which header cracking may cause.

BRIEF DESCRIPTION OF THE DRAWINGS

These and other objects, features and attendant advantages to the present invention will become better understood by reference to the following detailed description when considered in connection with the accompanying drawing wherein.

DETAILED DESCRIPTION OF THE PREFERRED EMBODIMENT

Figure 1:
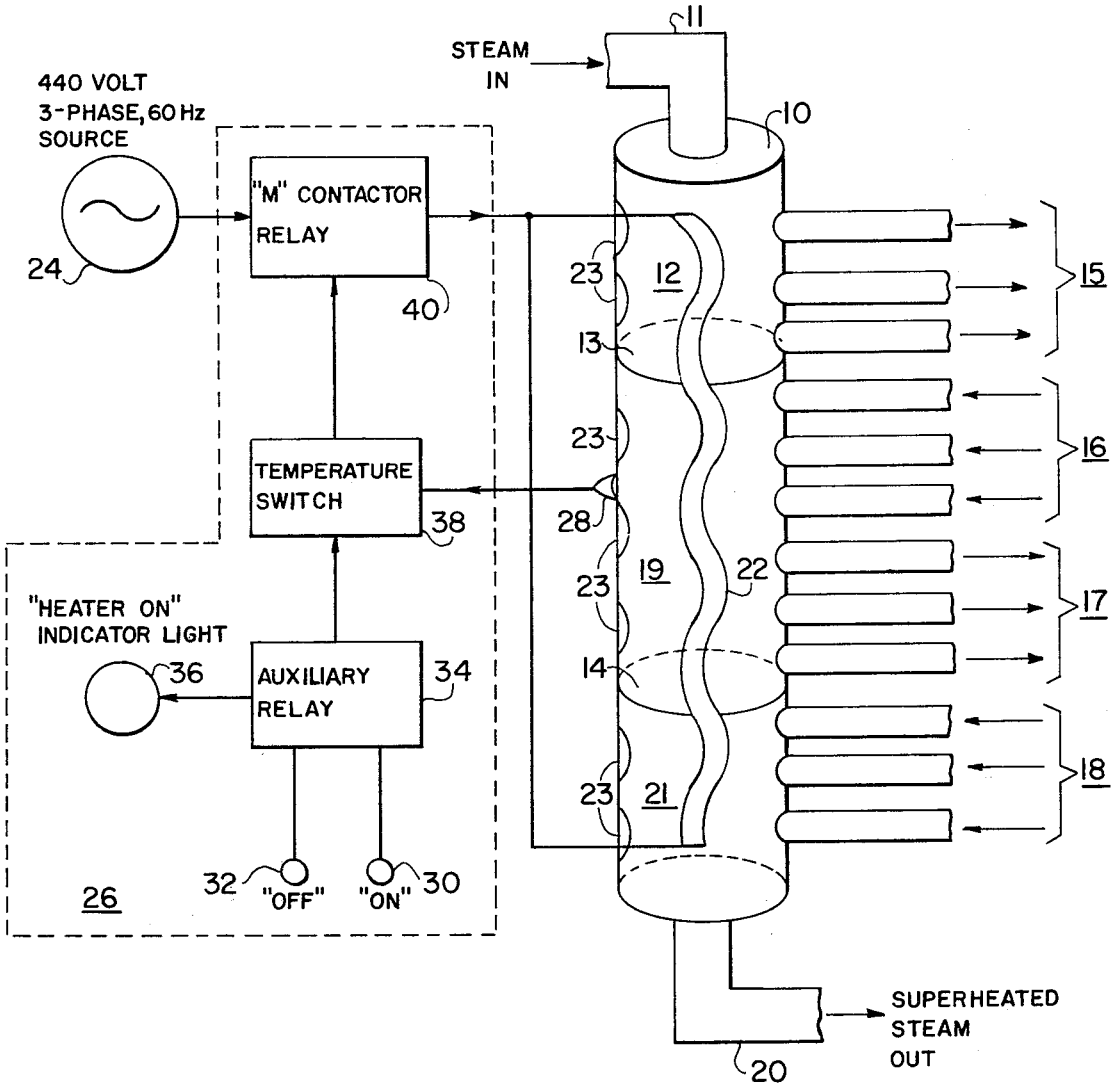
FIG. 1 shows a superheater header with an electrical heating element according to the present invention.

Referring now to the drawings and more particularly to FIG. 1, there is shown a boiler superheater header 10 having an inlet pipe 11 to provide steam to the header. The source of the steam applied to inlet pipe 11 may be the boiler (not shown) to which header 10 is connected or, in the case of protection steam, an auxiliary source (not shown). After entering header 10, the steam will proceed downward in first section 12 under pressure from its source until it reaches division plate 13 which blocks its further passage. Since the steam can no longer flow downward in header 10, it will be forced into superheater tubes 15. Superheater tubes 15 can lead to an outlet header (not shown) similar to header 10. The steam will be returned by superheater tubes 16 to the top of second section 19 following which the source pressure and division plate 14 will force it into superheater tubes 17 at the bottom of second section 19, and then into final section 21 via superheater tubes 18. All superheater tubes pass close to the boiler flame (not shown) which causes the steam therein to reach a superheated state. Header 10 can be designed with as many sections and division plates as needed to pass the steam back and forth through the superheater tubes to attain the desired outlet temperature. The steam will eventually exit through the last section 21 of header 10 in superheater form from outlet pipe 20. Removable handhole plates 23 are provided to allow accessability to the interior of header 10.

To accomplish the preheating of the header in accordance with the invention, an electrical heating element 22 is located on the external surface of the header 10 extending longitudinally from the first section 12 to last section 21. Heating element 22 is coupled to voltage source 24 via control circuit 26, both exterior of header 10 and external to the boiler proper. Perferably, but not necessarily, heating element 22 is a strip-type 3-phase heating element and voltage source 24 is a 440 volt, 3-phase, 60 Hz source. Heating element 22 should be capable of withstanding at least 1200° F and designed for contact metal heating. Electrical wiring leading to heater element 22 should be capable of continuously withstanding an ambient temperature of 500° F. Control circuit 26 is preferably marine type with a drip proof enclosure. Temperature sensor 28 is located on the exterior of header 10 to provide an indication of header temperature to control circuit 26, coupled thereto. "On" and "OFF" push-buttons 30 and 32 are coupled to auxiliary relay 34 which in turn is coupled to "HEATER ON" indicator light 36 and temperature switch 38. Temperature switch 38 is also coupled to temperature sensor 28 (located on header 10) and "M" contactor relay 40 (i.e. the main contactor relay). "M" contractor relay 40 is coupled between heating element 22 and voltage source 24. Temperature switch 38 has contacts which are normally closed at all sensed temperatures below a certain maximum temperature $T_{max}$. Once $T_{max}$ is reached, however, the contacts will open and remain open until a predetermined lower temperature $T_{min}$ is reached after which the contacts will again close.

In operation, with temperature switch 38 closed, heating element 22 can be energized by pressing "ON" pushbutton 30. This close auxiliary relay 34 which energizes "HEATER ON" indicator light 36 and closes "M" contactor relay 40. Since "M" contactor relay 40 is closed, the heating element 22 is connected to voltage source 24 and will begin to heat up header 10. Heating element 22 will continue to heat until temperature sensor 28 indicates that the header temperature has reached $T_{max}$. At this point the contacts of temperature switch 38 will automatically open thereby switching off "M" contactor relay 40 and disconnecting heating element 22 from voltage source 24. The heating element 22 will remain off until temperature sensor 28 indicates that the header temperature has decreased to $T_{min}$, closing temperature switch 38 and "M" contactor relay 40 to reconnect heating element 22 to voltage source 24. In this manner the header temperature can be maintained in a desired range, generally 350° F to 450° F.

Figure 2:
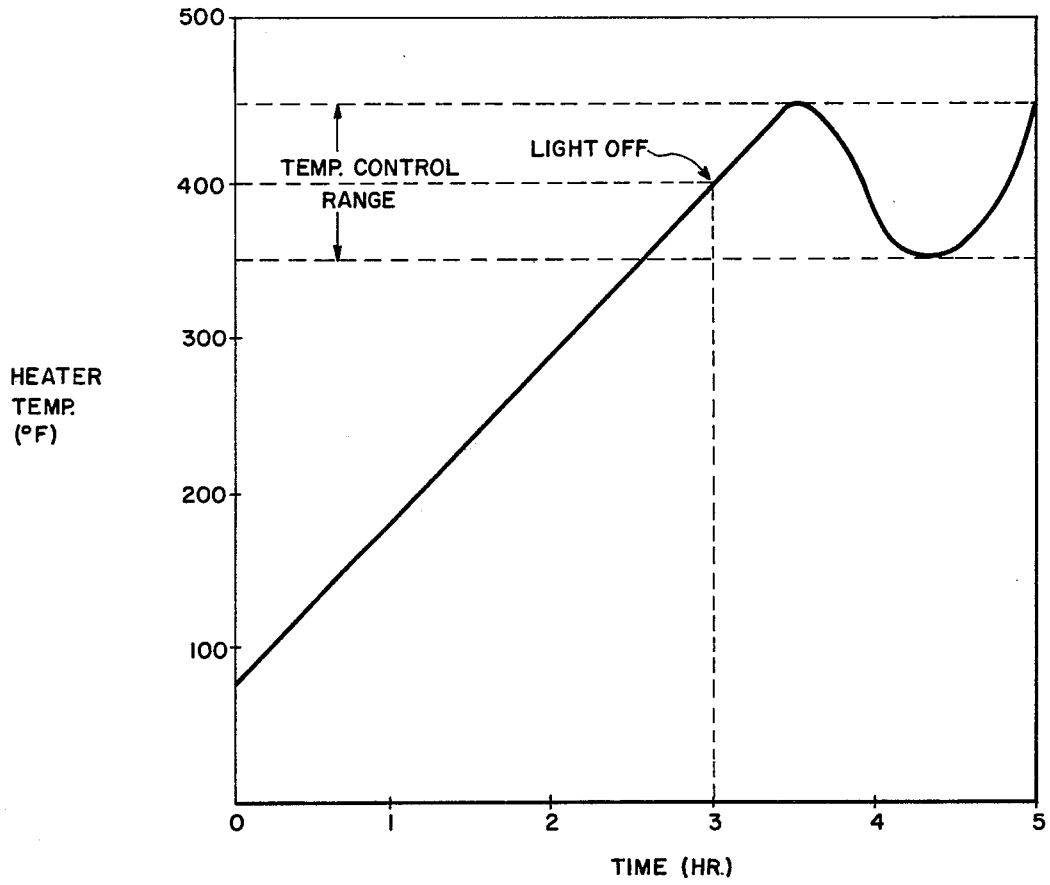
FIG. 2 shows a graph of header temperature vs. time in accordance with the invention.

FIG. 2 shows a graph of a gradual warm up of a header made possible by use of this invention. The preheating from a temperature of 75° F to a desired temperature of 400° F at boiler light-off takes approximately 3 hours, however, this may be extended or curtailed depending on the size of the heating unit and time frame requirements of the operator. The heating element 22 remains connected until header temperature reaches 450° F, at which time temperature switch 38 will disconnect it, and remain disconnected until the header temperature decreases to 350° F. Note that once steam is present in header 10, heating element 22 will ensure that the header remains at least at a temperature of 350° F, but will not prevent temperatures above 450° F if they can be attained by the steam alone. At450° F and higher heating element 22 is shutdown (non-energized) and header 10 will be free to follow whatever higher temperature its surrounding environment dictates.

There has therefore beeen provided a convenient means for preheating boiler superheater headers to prevent thermal shock caused by introduction of steam to the headers and alleviate the problem of header cracking. Obviously, numerous modifications and variations of the present invention are possible in light of the above teachings. It is therefore to be understood that within the scope of the appended claims the invention may be practiced otherwise than as specifically described therein.

We claim:

1. A superheater header connected to the outlet of a boiler comprising:

at least one inlet for steam to enter said header;

at least one outlet for steam to exit from said header; and means for preheating said header to a desired temperature prior to both boiler light-off and the introduction of steam into said header to prevent thermal shock to said header.

2. A superheater header as set forth in claim 1 further comprising means for maintaining the header temperature within a predetermined range around said desired temperature.

3. A superheater header as set forth in claim 1 wherein said preheating means comprises an electrical heating element located on the external surface of said header coupled to a voltage source exterior of said header.

4. A superheater header connected to the outlet of a boiler comprising:

at least one inlet for steam to enter said header;

at least one outlet for steam to exit from said header; and means for preheating said header to a desired temperature prior to both boiler light-off and the introduction of steam into said header to prevent thermal shock to said header, said preheating means comprising:

an electrical heating element located on the external surface of said header coupled to a voltage source exterior to said header;

a temperature sensor for sensing the header temperature;

a relay means coupling said electrical heating element to said voltage source; and a temperature switch coupling said temperature sensor to said relay means, said temperature switch operating to control said relay to couple said voltage source to said heating element to maintain the header temperature within a predetermined range around the desired temperature after the desired temperature has been reached.

5. A superheater header as set forth in claim 4 wherein said heating element is a 3-phase heating element and said voltage source is a 3-phase voltage source.

6. A superheater header as set forth in claim 4 wherein said desired temperature is approximately 400° F and said temperature range is between 350° F and 450° F.

7. A superheater header as set forth in claim 4 wherein said desired temperature is approximately 400° F and said temperature range is between 350° F and 450° F.

8. A process for preventing thermal shock in a superheater header connected to the output of a boiler and to superheater tubes conprising:

preheating said header to a desired temperature prior to both boiler light-off and the introduction of any steam to said header.

9. A process as set forth in claim 8 further comprising:

sensing the temperature of said header; and controlling the temperature of said header in response to said sensed temperature to remain within a temperature range around said desired temperature after said desired temperature has been reached.

10. A process for preventing thermal shock in a superheater header connected to the output of a boiler and to superheater tubes comprising:

preheating said header to a desired temperature prior to both boiler light-off and the introduction of any steam to said header;

sensing the temperature of said header; and controlling the temperature of said header in response to said sensed temperature to remain within a temperature range around said desired temperature after said desired temperature has been reached; said step of controlling further comprises:

placing an electrical heating element on the external surface of said header;

connecting said electrical heating element to a voltage source exterior of said header until said desired temperature is reached;

disconnecting said electrical heating element from said voltage source whenever the temperature of said header reaches a predetermined maximum temperature greater than said desired temperature; and reconnecting said electrical heating element to said voltage source whenever the temperature of said header reaches a predetermined minimum temperature less than said desired temperature.

11. A process as set forth in claim 10 wherein said desired temperature is apporximately 400° F and said temperature range is apporximately 350° F to 450° F.

12. A process as set forth in claim 10 wherein said desired temperature is approximately 400° F, said predetermined maximum temperature is 450° F and said predetermined minimum temperature is 350° F.

* * * * *